US010697741B2

(12) United States Patent
Thieme

(10) Patent No.: US 10,697,741 B2
(45) Date of Patent: Jun. 30, 2020

(54) IGNITION SYSTEM FOR PYROTECHNIC ARTICLES

(71) Applicant: Ringo Thieme, Borkwalde (DE)

(72) Inventor: Ringo Thieme, Borkwalde (DE)

( * ) Notice: Subject to any disclaimer, the term of this patent is extended or adjusted under 35 U.S.C. 154(b) by 112 days.

(21) Appl. No.: 15/537,491

(22) PCT Filed: Dec. 21, 2015

(86) PCT No.: PCT/EP2015/080881
§ 371 (c)(1),
(2) Date: Nov. 13, 2017

(87) PCT Pub. No.: WO2016/097423
PCT Pub. Date: Jun. 23, 2016

(65) Prior Publication Data
US 2018/0106579 A1 Apr. 19, 2018

(30) Foreign Application Priority Data
Dec. 19, 2014 (DE) ..... 10 2014 119 296

(51) Int. Cl.
*F42B 4/24* (2006.01)
*F42B 4/20* (2006.01)

(52) U.S. Cl.
CPC . *F42B 4/20* (2013.01); *F42B 4/24* (2013.01)

(58) Field of Classification Search
CPC ..... F42B 4/24; F42B 4/26; F42B 4/14
USPC ..... 102/275.11, 275.12, 275.7
See application file for complete search history.

(56) References Cited

U.S. PATENT DOCUMENTS 1,393,585 A * 10/1921 Sutton ..... F42C 1/06 102/252
3,528,370 A * 9/1970 Gaither ..... C06C 5/06 102/336
4,282,814 A * 8/1981 Menz ..... F42C 19/0834 102/275.5

(Continued)

FOREIGN PATENT DOCUMENTS

DE 1157121 11/1963
DE 2119425 A1 * 10/1972 ..... F24B 4/22

(Continued)

OTHER PUBLICATIONS

Internationaler Recherchenbericht und Schriftlicher Bescheid [International Search Report and the Written Opinion] dated Jul. 8, 2016 From the International Searching Authority Re. Application No. PCT/EP2015/080881 and Its Translation of Search Report Into English. (23 Pages).

(Continued)

*Primary Examiner* — Stephen Johnson

(57) ABSTRACT

The invention relates to a pyrotechnic article (10), comprising at least one first receiving part (11) for a pyrotechnic effect (20) and at least one ignition means (40) connected to the pyrotechnic effect (20). Moreover, at least one auxiliary ignition system (30) is provided, which can be ignited by the ignition means (40), wherein an igniting flame (31) can be generated by the auxiliary ignition system (30), and the igniting flame (31) can, in particular, be directed substantially horizontally out of the pyrotechnic article (10), whereby at least one additional pyrotechnic article comprising a pyrotechnic effect can be ignited.

17 Claims, 6 Drawing Sheets

(56) References Cited

U.S. PATENT DOCUMENTS

| | | | | |
|---|---|---|---|---|
| 8,286,556 | B2 * | 10/2012 | Zhong | F42B 4/24 102/335 |
| 2006/0207462 | A1 * | 9/2006 | Voigt | F42B 4/24 102/342 |

FOREIGN PATENT DOCUMENTS

| | | |
|---|---|---|
| DE | 29504875 | 7/1995 |
| DE | 29906172 | 7/1999 |
| DE | 112004001284 | 3/2013 |
| GB | 2330896 | 5/1999 |

OTHER PUBLICATIONS

Prüfungsantrag [Request for Examination] dated Nov. 22, 2018 From the Deutsches Patent- und Markenamt [German Patent and Trademark Office] Re. Application No. 102014119296.6 and Its Translation Into English. (11 Pages).

Notification of Office Action dated Jun. 4, 2019 From the State Intellectual Property Office of the People's Republic of China Re. Application No. 201580075591.1 and Its Translation Into English. (13 Pages).

* cited by examiner

IGNITION SYSTEM FOR PYROTECHNIC ARTICLES

RELATED APPLICATIONS

This application is a National Phase of PCT Patent Application No. PCT/EP2015/080881 having International filing date of Dec. 21, 2015, which claims the benefit of priority of German Patent Application No. 10 2014 119 296.6 filed on Dec. 19, 2014. The contents of the above applications are all incorporated by reference as if fully set forth herein in their entirety.

FIELD AND BACKGROUND OF THE INVENTION

The present invention relates to a pyrotechnic article according to the preamble of claim 1, comprising at least one first receiving part for a pyrotechnic effect, and to at least one ignition means connected to the pyrotechnic effect. The present invention moreover relates to a firework battery comprising at least one pyrotechnic article, and to a method for igniting at least one second firework.

Pyrotechnic articles which ignite a pyrotechnic effect disposed in a pyrotechnic article by way of an ignition means are known from the general prior art. The ignition means is generally a fuse, which is routed from the pyrotechnic effect to the outer side of the pyrotechnic article so that the fuse can be lit by a user. Additionally, firework batteries are known which comprise a plurality of pyrotechnic articles, which are pyrotechnically connected among one another by way of an ignition means. If a plurality of pyrotechnic articles and/or firework batteries are connected in series or in parallel, it is necessary in the general prior art to pyrotechnically connect the pyrotechnic articles or the firework batteries among one another by way of an ignition means, which is usually designed as a fuse. This is the only way to ensure that multiple pyrotechnic articles or firework batteries can be ignited simultaneously or concurrently. A pyrotechnic article is known from DE 11 2004 001 284 B4, which comprises at least one first receiving part for a pyrotechnic effect and at least one ignition means connected to the pyrotechnic effect. Ignition energy introduced by the ignition means on the pyrotechnic article is conducted through a connecting channel to a second pyrotechnic article that is in contact with and connected to the first pyrotechnic article, so that a second pyrotechnic effect can be ignited.

The solutions from the prior art, however, have the disadvantage that the pyrotechnic articles or the firework batteries must be pyrotechnically connected to one another by way of an ignition means, which is usually designed as a fuse, and, accordingly, the materials thereof are always joined to and in contact with one another via this ignition means. The ignition means connecting the pyrotechnic articles or firework batteries represents a major potential source for possible failures or breaks. Quite frequently, environmental factors play a big role, impairing the function of the ignition means. Moisture in particular poses a big problem, since this is highly likely to prevent a pyrotechnic connection, suppressing the lighting of a pyrotechnic effect. Moreover, a connection of multiple pyrotechnic articles or firework batteries via an ignition means substantially limits the options of arranging the pyrotechnic articles or firework batteries geometrically with respect to one another. In particular, over-the-counter pyrotechnic articles or fireworks batteries, which are generally provided with a conventional fuse, are affected by this.

SUMMARY OF THE INVENTION

It is therefore the object of the present invention to at least partially eliminate at least one of the above-described disadvantages in a pyrotechnic article or a firework battery. In particular, it is the object of the present invention to create a pyrotechnic article, a firework battery, and a method for igniting, wherein pyrotechnic articles or firework batteries, which are disposed spaced apart from one another, are ignited in a simple and cost-effective manner, without these being connected among one another via a material ignition means.

The above object is achieved by a pyrotechnic article, a firework battery and by a method for igniting a firework battery. Further features and details of the invention will be apparent from the dependent claims, the description and the drawings. It goes without saying that features and details that are described in connection with the pyrotechnic article according to the invention also apply in connection with the firework battery according to the invention, and the method according to the invention, and conversely, so that mutual reference is made, or can be made, in each case to the individual aspects of the invention with respect to the disclosure.

The pyrotechnic article according to the invention comprises at least one first receiving part for a pyrotechnic effect and at least one ignition means connected to the pyrotechnic effect. The pyrotechnic effect may be comprised of a mixture of substances, which may be referred to herein as a first mixture of substances. It is essential to the invention that least one auxiliary ignition system is provided, which can be ignited by the ignition means, wherein the auxiliary ignition system can be used to generate an igniting flame, and the igniting flame can, in particular, be directed horizontally out of the pyrotechnic article, whereby at least one additional pyrotechnic article comprising a pyrotechnic effect can be ignited.

A receiving part shall be understood to mean a geometric body, also referred to herein as a volumetric body, in or on which at least one pyrotechnic effect can be disposed. A pyrotechnic effect is a mixture of substances for generating acoustic, visual, thermal or mechanical effects, wherein the mixture is composed of explosive substances that are subject to appropriate legal regulations, whereby increased safety regulations apply. An ignition means within the meaning of the invention shall be understood to mean all ignition means or auxiliary ignition means that are used to trigger or ignite a pyrotechnic effect. They supply the necessary initial energy for the chemical reactions of pyrotechnic substance mixtures. In particular, ignition means shall be understood to mean typical ignition means for manual lighting, wherein hereafter a non-exhaustive list of exemplary ignition means is provided. Fuses are among the most common ignition means, which are able to transfer the combustion to the pyrotechnic effect and, moreover, can also be designed as delay elements and allow delays of a few seconds, for example by way of a slowly burning fuse (time fuse, igniter cord, Chinese fuse, double tarred igniter). Furthermore, portfires are conceivable, in which a special magnesium composition is used, which additionally is not susceptible to moisture. Fuse igniters are usually composed of a sleeve having a friction head, which is rubbed against a frictional surface of a matchbox, for example, and thereby supplies the necessary initial energy for the chemical reaction. Within the scope of the invention, moreover ignition labels are also conceivable, which are made of an easily combustible material and appropriately transfer the ignition energy introduced by a match or a lighter to the pyrotechnic effect. Additionally, this may also be a membrane, which is configured in such a way that introduced thermal energy is passed via the membrane to the pyrotechnic effect, so that the necessary initial energy can be appropriately provided. An essential core of the invention is the auxiliary ignition system according to the invention, which can be ignited by the ignition means, whereby an igniting flame can be generated by a pyrotechnic effect and/or pyrotechnic object disposed in the auxiliary ignition system. Accordingly, the auxiliary ignition system comprises, among other things, a substance mixture for generating at least thermal effects, so that in this way initial energy, in the form of thermal energy, can be transferred. This substance mixture may also be referred to herein as a second mixture of substances. This thermal energy is generated in the form of an igniting flame by the auxiliary ignition system, wherein the igniting flame can, in particular, be directed substantially horizontally out of the pyrotechnic article, so that the thermal energy, which is required as initial energy for igniting an additional pyrotechnic article comprising an additional pyrotechnic effect, can be transferred. An igniting flame within the meaning of the invention accordingly replaces a material connection, for example in the form of a fuse, which is necessary to pyrotechnically connect at least two pyrotechnic articles and/or firework batteries among one another. Consequently, the amount of thermal energy that the igniting flame transfers is at least such that this is sufficient to supply the initial energy for igniting a further pyrotechnic effect. The igniting flame has an effect direction, which is directed substantially horizontally away from the pyrotechnic article, wherein horizontally away from the pyrotechnic article shall be understood to mean a horizontal propagation of a vertical or upright pyrotechnic article. In particular, this shall be understood to mean that the pyrotechnic article releases the substantial, this being the largest, portion of the pyrotechnic effect in a vertical or up direction. The vertical direction is thus generally the support area or the surface (ground) on which the pyrotechnic article is disposed, or the opposite direction (sky). The auxiliary ignition system according to the invention can be disposed in any arbitrary location of the pyrotechnic article, wherein this implies that the auxiliary ignition system can be partially or fully integrated into the pyrotechnic article and/or the first receiving part, or provided outside the pyrotechnic article. Within the scope of the invention, it is also conceivable that a plurality of auxiliary ignition systems are provided, wherein these can be disposed in differing locations of the pyrotechnic article and generate an igniting flame in differing directions. Accordingly, in the absence of the igniting flame, it is possible to ignite additional, which is to say external, pyrotechnic articles comprising pyrotechnic effects, wherein the pyrotechnic articles can each be disposed spaced apart and, in some circumstances, without contact with one another.

Within the scope of the invention, it is conceivable that the auxiliary ignition system is disposed in a second receiving part and, in particular, that an isolating element is at least partially disposed between the auxiliary ignition system and the pyrotechnic effect. The second receiving part shall likewise be understood to mean a geometric body, also referred to herein as a volumetric body, in or on which at least one chemical substance mixture for generating thermal effects or energy can be disposed. The second receiving part can be can-shaped, cylindrical, cuboid or pyramid-shaped or comprise similar volume bodies. The first receiving part and/or the second receiving part can comprise cellulose, plastic, wood or metal. The use of cellulose is particularly environmentally friendly since production using renewable resources is made possible, while incurring low material costs. The use of a plastic material offers the advantage of high durability and high resistance to environmental conditions as well as the application of forces, caused by transport or improper handling. Similar properties also result when using metal, wherein additionally an ecological advantage can be achieved by material recycling. Moreover, the first and/or the second receiving parts can also comprise gypsum, clay, quartz or ceramic, since these materials have good thermal resistance. According to the invention, it is conceivable that an isolating element is at least partially disposed between the auxiliary ignition system and the pyrotechnic effect. This isolating element can be configured in the form of a fireproof bottom of the second receiving part, for example. As a result of the isolating element according to the invention, the transfer of thermal energy from the auxiliary ignition system to the pyrotechnic effect is at least partially suppressed or reduced. Furthermore, the kinematic energy created by the ignited auxiliary ignition system is directed in a certain direction, this preferably being the direction out of the pyrotechnic article. In this way, it is achieved that the required initial energy for lighting a further pyrotechnic article comprising a pyrotechnic effect can be transferred in the desired direction. The isolating element can surround the second receiving part partially or completely, wherein advantageously an ignition means penetrates the isolating element and/or the second receiving part in at least one location. It is likewise conceivable that an aperture, which is to say a material cut-out, along the isolating element and/or the second receiving part serves as the ignition means when a chemical substance or material is present in this region, which is designed to transfer the initial energy for igniting the auxiliary ignition system or the pyrotechnic effect.

It is likewise advantageous when a jacket is disposed on the pyrotechnic article or the first receiving part. The jacket can be a label on which usage, hazard or other information is depicted. This may be disposed around the pyrotechnic article, or around the receiving part, in the form of a wrapper, for example. The jacket can be attached to the pyrotechnic article and/or to the receiving part, for example by way of an adhesive bond, a hook-and-loop fastener or a screw joint, and preferably can comprise cellulose, plastic, wood or metal. The use of cellulose is particularly environmentally friendly since production using renewable resources is made possible, while incurring low material costs. The use of a plastic material offers the advantage of high durability and high resistance to environmental conditions as well as the application of forces, caused by transport or improper handling. Similar properties also result when using metal, wherein additionally an ecological advantage can be achieved by material recycling.

It is furthermore conceivable that the ignition means protrudes at least partially from the first receiving part for the pyrotechnic effect and/or from the jacket of the pyrotechnic charge and/or from the second receiving part for the auxiliary ignition system. If the ignition means protrudes at least partially from the first receiving part for the pyrotechnic effect and/or from the jacket of the pyrotechnic charge, this corresponds to an ignition means which is accessible from the outside and to which initial energy is applied by the user, whereby this energy is conducted via the ignition means to the pyrotechnic effect. This may be a fuse, for example, which is lit from the outside by a user, so that the thermal energy is conducted via the fuse to the pyrotechnic effect. If the ignition means protrudes only from the first receiving part, the ignition means can thus, for example, still be situated behind the jacket, so that the jacket at least partially protects the ignition means from environmental conditions by enveloping the same. The same applies to the arrangement of the ignition means on or in the second receiving part for the auxiliary ignition system, so that the initial energy can be introduced by the user from outside. Accordingly, by introducing the initial energy, both the pyrotechnic effect and the auxiliary ignition system can be ignited if the ignition means protrudes from the first receiving part for the pyrotechnic effect and/or from the jacket of the pyrotechnic article and/or from the second receiving part for the auxiliary ignition system.

According to the invention, the pyrotechnic effect and the auxiliary ignition system can be pyrotechnically connected to one another by way of the ignition means. For this purpose, it is necessary that the ignition means is disposed, at least in sections, in the pyrotechnic effect or in the first receiving part and, at least in sections, in the auxiliary ignition system or the second receiving part for the auxiliary ignition system. As a result of the pyrotechnic connection, the pyrotechnic effect and the auxiliary ignition system can be ignited by introducing the initial energy only in one location, or only at one end of the ignition means. The pyrotechnic connection can be connected by way of a fuse and/or a pyrotechnic separating layer, touchpaper, a percussion cap or a suitable ignition means as described above.

Furthermore, it is conceivable that at least one positioning aid and/or one support aid is disposed on the first receiving part and/or on the jacket. In particular, it is conceivable that the positioning aid and/or the support aid is formed of part of the jacket. The positioning aid is used to position the pyrotechnic article or the receiving part in such a way that the auxiliary ignition system is disposed in a suitable position for igniting an opposing pyrotechnic article, so that the igniting flame is able to transfer sufficient initial energy to ignite a further pyrotechnic effect. A support aid within the meaning of the invention is used to increase the stability of the pyrotechnic article, in particular when the auxiliary ignition system has been lit, and energy is created by the combustion of the explosive chemical mixture, which may possibly move the pyrotechnic article out of the original position thereof. This increases the stability, as a result of which the pyrotechnic effect and/or the auxiliary ignition system are not moved into an undesirable position in which the pyrotechnic effect and/or the auxiliary ignition system can cause damage to surrounding objects and/or injury to surrounding persons. According to the invention, it can be advantageous that the positioning aid and/or the support aid are formed by a section of the jacket, so that the positioning aid and/or the support aid are designed in one piece or formed of uniform materials. Moreover, the positioning aid and/or the support aid can comprise additional reinforcement elements, which are disposed on and/or in the positioning aid and/or the support aid in the form of reinforcement struts or inserts, in particular made of a plastic material or a metallic material.

Within the scope of the invention, the positioning aid and/or the support aid can comprise at least one connecting means, whereby an at least mechanical connection can be established with at least one connecting means disposed on an additional pyrotechnic article. A connecting means according to the invention can be designed, for example, as a material recess or a correspondingly shaped element, which allows at least two connecting means to be connected to one another in a form-locked and/or force-fit manner. A complementary geometry of the connecting means can be provided for this purpose, or the connecting means can be designed, for example, as slots in the positioning aid or the support aid, so that two connecting means can be nested inside one another or inserted into one another. Furthermore, it is conceivable that the connecting means is designed as a hook or an eyelet, and two respective corresponding connecting means can be connected to one another in this way. Adhesive bonds and/or hook-and-loop fasteners are also conceivable, for example, whereby an at least force-fit and/or form-locked connection can be established. In particular, it is conceivable that, prior to use, the adhesive bond and/or hook-and-loop fastener are protected with a protection element, such as a protective film, against outside influences (such as dirt, moisture) and inadvertent adhesion. A connecting element according to the invention, in all exemplary embodiments, enables a connection of at least pyrotechnic articles, so that the stability of the individual pyrotechnic articles is increased and, at the same time, a positioning of the pyrotechnic article with respect to one another can be established, whereby, for example, the pyrotechnic effects can be influenced in the direction of action/arrangement thereof (circular or at a specific angle with respect to one another). The spacing of the pyrotechnic articles from one another can also be established in this way, so that, as a result of the pyrotechnic effects, a displacement of the pyrotechnic articles is at least substantially suppressed.

According to the invention, it is conceivable that the positioning aid and/or the support aid are movably disposed on the receiving part. The positioning aid and/or the support aid can particularly advantageously be disposed in a folding manner on the receiving part and/or on the jacket. For this purpose, it may be provided that the positioning aid and/or the support aid comprise a hinge, whereby these can be freely positioned. In a folding manner within the meaning of the invention shall be understood to mean a positioning aid and/or a support aid that can be moved in a horizontal direction and/or in a vertical direction. In this way, it is made possible that, on the one hand, the stability can be improved in such a manner that mechanical forces can be transferred from the pyrotechnic article onto a support base, wherein, in particular by way of a folding mechanism, the position of the positioning aid and/or of the support aid can be adapted to the support base, and, on the other hand, an existing connecting means can thereby be variably positioned with a connecting means present on a further pyrotechnic article.

The positioning aid and/or the support aid according to the invention can, in particular, be brought at least into a closed position and into an open position, wherein the positioning aid and/or the support aid are disposed substantially flush on the receiving part in the closed position, and a connection to at least one positioning aid and/or support aid disposed on the additional pyrotechnic article can be established in the open position. Accordingly, the pyrotechnic article has a small space requirement in the closed position, and the positioning aid and/or the support aid can be brought into the open position only when needed.

It is likewise advantageous that the auxiliary ignition system can be disposed on or in the jacket and/or on or in the first receiving part. According to the invention, it is conceivable that the auxiliary ignition system or the second receiving part is disposed in the first receiving part, where the pyrotechnic effect is also accommodated. The auxiliary ignition system can moreover also be in contact with the jacket, or can at least partially have a form-locked and/or force-fit connection. For this purpose, the auxiliary ignition system can be connected to the first receiving part and/or to the jacket by way of a bonded, plug-in, detent or screw joint.

According to the invention, the isolating element can comprise cellulose and/or gypsum and/or clay and/or quartz and/or metal and/or ceramic. In particular, when cellulose is used, this may be coated so as to further improve the material properties, and in particular, so as to increase the thermal resistance of the cellulose. Gypsum, clay, quartz, metal or ceramic have high thermal resistance, so that the auxiliary ignition system can be isolated from the pyrotechnic effect thermally and pyrotechnically. In this way, it can be achieved, for example, that a staggered combustion of the auxiliary ignition system or of the pyrotechnic effect can be created by way of targeted isolation using an isolating element.

According to the invention, a safety element can be arrangeable on the auxiliary ignition system, whereby the igniting flame can be suppressed from exiting. Suppressing the exiting of the igniting flame from the auxiliary ignition system or the pyrotechnic article can be advantageous if the pyrotechnic article is to be used on its own, without the combustion of further external pyrotechnic articles. The safety element can correspondingly, in a manner similar to the isolating element, comprise cellulose and/or gypsum and/or clay and/or quartz and/or metal and/or ceramic, whereby high thermal resistance is provided. The safety element preferably has at least the same geometric size that the igniting flame of the auxiliary ignition system can maximally achieve. The safety element can be designed to be reversible and/or latchable and/or screwable and/or bonded. Moreover, this can comprise predetermined breaking points, or it may be glued only locally, so that it may be attached or removed as needed. The safety element can also be configured in the form of a safety label, for example in the form of the jacket. At the location at which the auxiliary ignition system is disposed, the jacket can comprise predetermined breaking points or a perforation, so as to be removable from the jacket as needed. In this way, it is achieved that an igniting flame inadvertently exiting the auxiliary ignition system or the pyrotechnic article is suppressed, whereby damage to outside objects or injury to persons is prevented. Additionally, inadvertent ignition of the auxiliary ignition system is at least partially suppressed by a safety element, or the resulting effect is substantially suppressed.

Within the scope of the invention, it is conceivable that a safety mechanism for the auxiliary ignition system is provided, whereby, in particular, the ignition means can be pyrotechnically isolated or connected. A safety mechanism according to the invention is used to interrupt the ignition means, so that the initial energy for igniting the pyrotechnic effect and/or the auxiliary ignition system can be interrupted. This also suppresses an inadvertent ignition of the pyrotechnic effect and/or of the auxiliary ignition system, whereby the safety is further increased. This may be a mechanical device and/or a material property, for example, which allows the ignition means and/or the auxiliary ignition system to be pyrotechnically isolated or to be connected. This can be achieved, for example, by isolating the ignition means or by introducing additional material between the ignition means and the auxiliary ignition system or the pyrotechnic effect. If, for example, the ignition means routed to the outside is isolated by way of the safety mechanism, or removed from the auxiliary ignition system, a pyrotechnic connection no longer exists between the ignition means and the auxiliary ignition system. Consequently, the required initial energy for lighting the auxiliary ignition system can no longer be transferred, so that the igniting flame is prevented from exiting the auxiliary ignition system. It is likewise conceivable that the ignition means can only be introduced into the auxiliary ignition system by the safety mechanism, so that initial energy cannot be introduced via the auxiliary ignition system until the safety mechanism has been actuated.

Furthermore, it is conceivable that the igniting flame has an angle of radiation $\alpha$ relative to the horizontal in a range between 90° and 0°, advantageously between 44° and 20°, and preferably between 19° and 0°. The angle of radiation $\alpha$ is a geometric definition of the range present between the horizontal axis of symmetry of the auxiliary ignition system and the jacket or the pyrotechnic article. Accordingly, the angle of radiation $\alpha$ between the horizontal and the jacket of the pyrotechnic article can have a range between 0° and 90°, wherein 0° forms the horizontal, or the horizontal axis of symmetry of the auxiliary ignition system. To ensure that the largest possible portion of initial energy of the initial energy generated by the auxiliary ignition system, and thus the majority of the igniting flame, reaches the direction of the second spaced, external pyrotechnic article, the angle of radiation $\alpha$ advantageously has a range between 44° and 20°. It is particularly preferred when the igniting flame has an angle of radiation $\alpha$ in the range between 19° and 0°, since in this range the largest possible portion of the igniting flame, and thus of the required initial energy for igniting a further pyrotechnic article, is directed out in the desired direction.

According to the invention, the igniting flame can have an exit length in the range of 2 mm and 300 mm, advantageously between 5 mm and 150 mm, and preferably between 10 mm and 50 mm. The exit length determines the possible geometrical arrangement of the two opposing pyrotechnic articles, so that sufficient initial energy can be transferred by the igniting flame from the one pyrotechnic article, or from the first auxiliary ignition system, to the second pyrotechnic article.

It is likewise advantageous when the igniting flame has a burn time in the range between 25 seconds and 60 seconds, advantageously between 29 seconds and 45 seconds, and preferably between 1 second and 15 seconds. A shorter burn time increases the safety with respect to outside persons or uninvolved objects, so that injury or damage to these can be largely reduced. A longer burn time, in contrast, provides a higher likelihood for the combustion of a further pyrotechnic article, in particular when the transfer conditions for transferring the initial energy via the igniting flame are impaired by environmental factors.

Furthermore, it is conceivable that the igniting flame can be achieved by a pyrotechnic signal ignition means and/or a bengal fire and/or a shellac fire and/or a flame surface and/or a pyrotechnic effect and/or a pyrofluid. The use of a pyrotechnic signal ignition means and/or of a bengal fire and/or of a shellac fire and/or of a pyrotechnic effect makes it possible to achieve additional pyrotechnic effects, which at the same time serve to transfer the initial energy by the igniting flame to a further pyrotechnic article. The use of a flame surface or of a pyrofluid can have advantages in terms of space, since these, for example, are simply provided on an outer surface of the pyrotechnic article, or on the jacket of the pyrotechnic article.

According to a further aspect of the invention, a firework battery comprising at least one pyrotechnic article, in particular one according to the invention, is claimed. The pyrotechnic article of the firework battery consequently comprises at least one first receiving part for a pyrotechnic effect and at least one ignition means connected to the pyrotechnic effect. At least one auxiliary ignition system can be provided on the pyrotechnic article according to the invention, which can be ignited by the ignition means, wherein the auxiliary ignition system can be used to generate an igniting flame, and the igniting flame, in particular, can be substantially directed out of the pyrotechnic article, whereby at least one additional pyrotechnic article comprising pyrotechnics effect can be ignited. Accordingly, a firework battery according to the invention comprising at least one pyrotechnic article according to the invention can ignite a further pyrotechnic article and/or a further firework battery, which is disposed spaced apart from the first firework battery or from the first pyrotechnic article, in particular without a fuse being present.

A firework battery according to the invention thus entails the same advantages as those that were described in detail with respect to a pyrotechnic article according to the invention.

Advantageously, the firework battery comprises at least one receiving part for at least one pyrotechnic article according to the invention and a border, which, via at least one hinge part, is connected to a further receiving part and/or an extension element that continues the border and that is arranged on a receiving part, wherein the axis of rotation of the hinge part is arranged vertically in relation to a ground, whereby the geometric arrangements of the receiving part and/or the extension element are movable relative to one another, whereby a bordered support base of the firework battery is enlarged.

According to the invention, at least one receiving part and/or one extension element can be secured by way of at least one foldable brace element. The brace element can be designed to cover the entire surface area, a partial surface area or merely as a rib compared to the receiving part or extension element. The brace element can be folded about a horizontal axis from a transport position into a usage position, wherein, in the transport position, the extension element has only little influence on the space requirement, and in the usage position, the brace element reinforces the receiving part and/or the extension element when folded open. The receiving part and/or the extension element are thus retained in the folded-open forms thereof, whereby the stability is further increased, and a displacement of the at least one receiving part or of the at least one extension element is prevented. Moreover, the surface area of the brace element likewise offers additional options for positioning hazard information, instructions, or advertisement.

It is furthermore conceivable that at least one additional pyrotechnic article according to the invention can be received in the support base, and in particular on the brace elements, and in particular that at least one further pyrotechnic article can be secured by at least one brace element and/or one retaining element. The enlarged bordered support base of the firework battery when folded out creates new space, in which at least one further pyrotechnic article can be received, for which there is no room when the firework battery is folded together. This turns the support base into a receiving part for at least one pyrotechnic article, whereby the stability of the firework battery is further increased. In addition, a plurality of pyrotechnic articles within the support base positively influences the visual design and number of pyrotechnic effects.

A pyrotechnic article according to the invention disposed in the firework battery makes it possible that further pyrotechnic articles disposed in the firework battery can be lit via the auxiliary ignition system, in particular also when no connection among one another by way of a fuse exists. Even in the case of an enlarged support base of the firework battery, the auxiliary ignition system, as a result of the receiving parts and/or extension elements movable in relation to one another, allows the pyrotechnic articles to ignite one another. After a first pyrotechnic article of the firework battery has been lit, the auxiliary ignition system, which can be ignited by the ignition means, can consequently generate an igniting flame, wherein the igniting flame is directed, in particular, substantially horizontally out of the pyrotechnic article, whereby at least one additional pyrotechnic article comprising a pyrotechnic effect is ignited.

According to a further aspect of the invention, a method for igniting at least one second pyrotechnic article by way of a first pyrotechnic article is claimed, wherein the second pyrotechnic article is disposed spaced apart from and without contact with the first pyrotechnic article, and an auxiliary ignition system of the first pyrotechnic article ignites the second pyrotechnic article. Accordingly, a second pyrotechnic article can be ignited by the auxiliary ignition system of the first pyrotechnic article without a material connection being present to the first pyrotechnic article.

The described firework battery and the described method result in all the advantages that were already described with respect to the pyrotechnic article according to the invention.

BRIEF DESCRIPTION OF THE SEVERAL VIEWS OF THE DRAWINGS

Further measures improving the invention will be apparent from the following description of several exemplary embodiments of the invention, which are schematically illustrated in the figures. All of the features and/or advantages that are apparent from the claims, the description or the drawings, including design details, arrangements in terms of space, and method steps, can be essential to the invention, both alone and in a wide variety of combinations. The drawings in each case show schematic illustrations:

DESCRIPTION OF SPECIFIC EMBODIMENTS OF THE INVENTION

Figure 1:
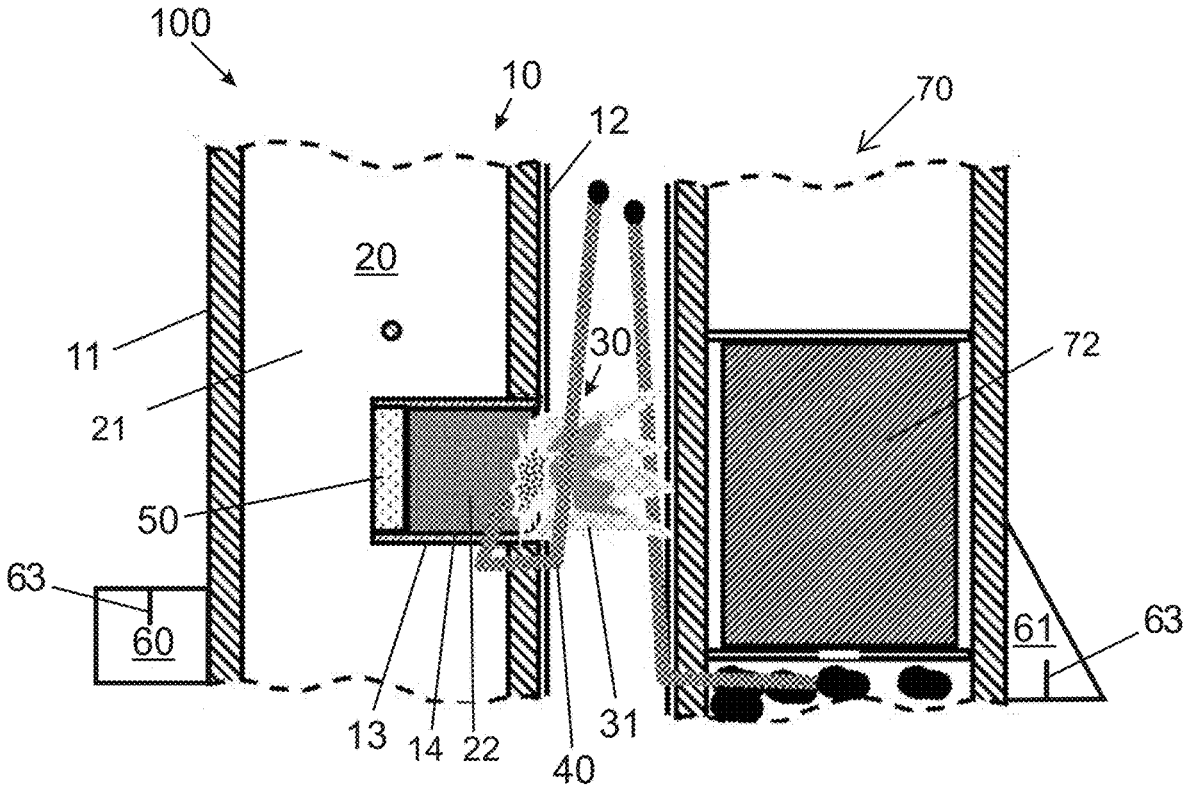
FIG. 1 shows a first embodiment of the firework battery according to the invention comprising a pyrotechnic article and an additional pyrotechnic article according to the invention.

Elements and features having identical technical functions and modes of operation are in each case denoted by identical reference numerals in FIGS. 1 to 12.

FIG. 1 schematically shows a firework battery 100 according to the invention, comprising a pyrotechnic article 10 according to the invention, which here, by way of example, comprises at least one first receiving part 11 for a pyrotechnic effect 20 and at least one ignition means 40 connected to the pyrotechnic effect 20. The pyrotechnic effect 20 may be comprised of a first mixture of substances 21. In FIG. 1, the ignition means 40 connects the auxiliary ignition system 30 to the pyrotechnic effect 20 and is directed out of the same through the receiving part 11 and the jacket 12, whereby it is accessible from the outside. The auxiliary ignition system 30 may be comprised of a second mixture of substances 22, for example, a chemical substance mixture. The auxiliary ignition system 30, which can be ignited by the ignition means 40, is disposed in the first receiving part 11 in FIG. 1, wherein the jacket 12 forms the outermost edge of the pyrotechnic article 10. The auxiliary ignition system 30 is disposed in the receiving part 13, also referred to herein as a second receiving part, wherein an isolating element 50, which isolates the auxiliary ignition system 30 from the pyrotechnic effect 20, is disposed on the one side of the auxiliary ignition system 30. Receiving part 13 thus defines a volumetric body 14 disposed therein, for containing the second mixture of substances 22 that form the auxiliary ignition system 30. The receiving part 13 surrounds the auxiliary ignition system 30 on the remaining surface areas of the auxiliary ignition system 30, so that the same is pyrotechnically connected to the pyrotechnic effect 20 only by way of the ignition means 40. The igniting flame 31, which is generated by the auxiliary ignition system 30, is directed substantially horizontally out of the pyrotechnic article 10, so that an additional pyrotechnic article 70 spaced apart from the first pyrotechnic article 10 and containing an additional pyrotechnic effect 72, can be ignited by the igniting flame 31. The additional pyrotechnic article 70 spaced apart from the first pyrotechnic article likewise comprises an ignition means 40, which is lit by the igniting flame 31. In FIG. 1, the pyrotechnic article 10 comprises a positioning aid 60 and a support aid 61 on the receiving part 11 of the pyrotechnic article 10. According to the invention, the positioning aid 60 and/or the support aid 61 can be disposed in a folding manner on the receiving part 11 or on the jacket 12 of the pyrotechnic article 10. In particular, the support aid 61 is preferably disposed in the vicinity of the surface area with which the pyrotechnic article 10 is set on the ground, so that the pyrotechnic article 10 can be supported on the ground by way of the support aid 61. In contrast, the positioning aid 60 can be disposed in any arbitrary location on the pyrotechnic article 10 and can also be disposed reversibly, such as by way of latching, screwing or bonding. A further function of the positioning aid 60 and/or of the support aid 61 results from the connecting means 63 according to the invention, which is disposed both on the positioning aid 60 and on the support aid 61. In this way, an at least mechanical connection can be established to at least one connecting means 63 disposed on additional pyrotechnic article 70. Accordingly, it is conceivable that further pyrotechnic articles are disposed on the side of the pyrotechnic article 10 on which the connecting means 63 is disposed, and are connected. This further increases the stability. In FIG. 1, the connecting means 63 is designed as a vertical slot 63 or notch 63 in the positioning aid 60 and the support aid 61. This slot 63 makes it possible, for example, for the positioning aid 60 and the slot 63 of the support aid 61 to be inserted into or nested inside one another.

Figure 2:
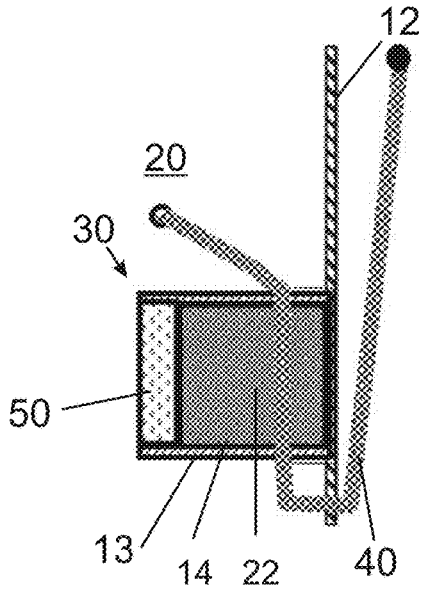
FIG. 2 shows a first embodiment of the auxiliary ignition system according to the invention.

FIG. 2 schematically shows the auxiliary ignition system 30, which is disposed on a jacket 12. The auxiliary ignition system 30 in FIG. 2 comprises an isolating element 50 and a receiving part 13. Receiving part 13 defines a volumetric body 14 disposed therein, for containing the second mixture of substances 22 that form the auxiliary ignition system 30. The ignition means 40 is routed from the outside through the jacket 12 and the receiving part 13, as well as through the auxiliary ignition system 30, and exits again on another side of the receiving part 13 of the auxiliary ignition system 30. Accordingly, a connection is obtained between the ignition means 40 and the pyrotechnic effect 20 and first mixture of substances 21, both above and beneath the auxiliary ignition system 30. This has the advantage that, when the pyrotechnic effect 20 is combusted, the portion of the ignition means 40 that is disposed in the pyrotechnic effect 20 can be ignited in two locations. Accordingly, the ignition means 40 can be ignited by the pyrotechnic effect 20 beneath the auxiliary ignition system 30. Additionally, the option exists that the ignition means 40 can likewise be ignited by the pyrotechnic effect 20 above the auxiliary ignition system 30, when a pyrotechnic effect 20 burns down from the bottom to the top. This provides a kind of fall-back level, and in the event that the ignition means 40 is not ignited at a first contact point with the pyrotechnic effect 20, the ignition means 40 is ignited by the second contact with the pyrotechnic effect 20. The auxiliary ignition system 30 is disposed on the jacket 12 in such a way that the jacket 12 forms the outermost edge layer of the pyrotechnic article 10. Accordingly, it is conceivable that the auxiliary ignition system 30 is connected to the jacket 12 on a contact surface therewith. This may be a bonded, screw or detent joint, for example. The jacket 12 thus forms a protective layer for the auxiliary ignition system 30, whereby the same is at least partially protected against environmental conditions and/or applications of forces.

Figure 3:
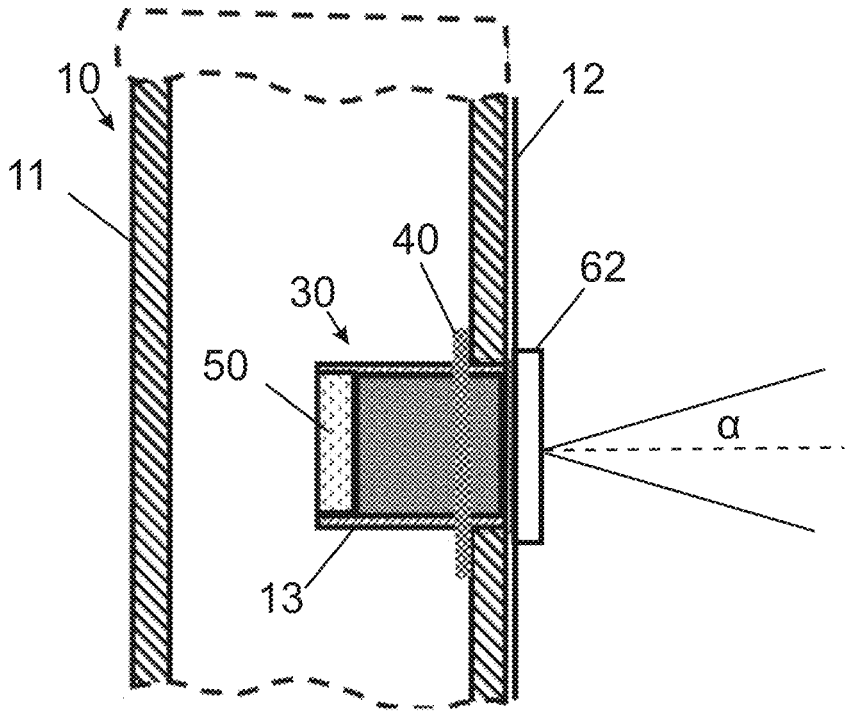
FIG. 3 shows a second embodiment of the auxiliary ignition system according to the invention.

FIG. 3 shows a pyrotechnic article 10 comprising a receiving part 11, wherein no pyrotechnic effect is present in the receiving part 11 in FIG. 3. This is conceivable, for example, when pyrotechnic effects are not disposed in every pyrotechnic article within a firework battery 100, but an auxiliary ignition system 30 for lighting further pyrotechnic articles and/or firework batteries is present. In FIG. 3, the auxiliary ignition system 30 is consequently disposed in the receiving part 11 behind a jacket 12 in such a way that the ignition means 40 penetrates the receiving part 13 for the auxiliary ignition system 30 in at least two locations of the receiving part 13. Furthermore, in FIG. 3 as well the auxiliary ignition system 30 comprises an isolating element 50, wherein the isolating element 50 is used, in particular, to direct the igniting flame of the auxiliary ignition system out of the receiving part 13 or out of the jacket 12. Furthermore, the safety element 62 is apparent in FIG. 3, which at least substantially suppresses the igniting flame from exiting. FIG. 3 likewise shows the horizontal axis of symmetry, wherein the angle of radiation $\alpha$ is shown on the horizontal. The angle of radiation $\alpha$ spans the region above and beneath the horizontal axis of symmetry in which the igniting flame preferably propagates. Accordingly, the angle of radiation $\alpha$ can extend in a range above the horizontal between 0° and 90°, and beneath the horizontal between 0° and 90°.

Figure 4:
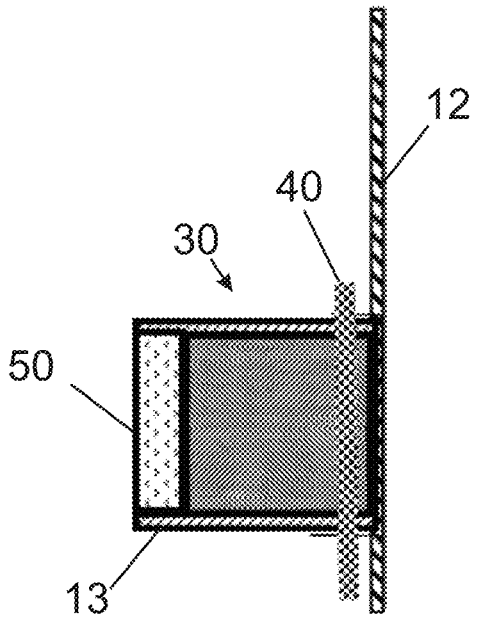
FIG. 4 shows a third embodiment of the auxiliary ignition system according to the invention.

FIG. 4 shows the auxiliary ignition system 30, which is disposed directly on the jacket 12, so that no receiving part 11 for receiving the second receiving part 13 is required here. The auxiliary ignition system 30, together with the receiving part 13, is disposed directly on the jacket 12 and, according to the invention, includes a bonded, detent or screw joint, for example. Again, the ignition means 40 passes through on both the upper side and the lower side of the receiving part 13 of the auxiliary ignition system 30. The isolating element 50 according to the invention, which is situated on the side of the receiving part 13 for the auxiliary ignition system 30 located opposite the jacket 12 is also shown.

Figure 5:
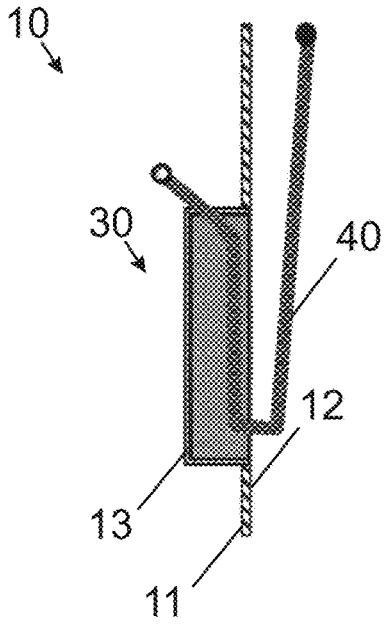
FIG. 5 shows a fourth embodiment of the auxiliary ignition system according to the invention.

FIG. 5 shows a further embodiment of the auxiliary ignition system 30, wherein the receiving part 13 of the auxiliary ignition system 30 is designed in the manner of a sleeve and, together with the jacket 12, forms the outermost edge of the pyrotechnic article 10. The ignition means 40 in FIG. 5 is located partially outside the pyrotechnic article 10 and, from there, is routed into the auxiliary ignition system 30, so that the auxiliary ignition system 30 can also be ignited from the outside by the ignition means 40. From the receiving part 13 for the auxiliary ignition means 30, the ignition means 40 is routed out of the second receiving part 13 and into the first receiving part 11. In this embodiment, the auxiliary ignition system 30 requires comparatively little installation space, whereby the same terminates the pyrotechnic article 10 directly with the jacket 12 and due to the sleeve-like shape has a relatively compact design.

Figure 6:
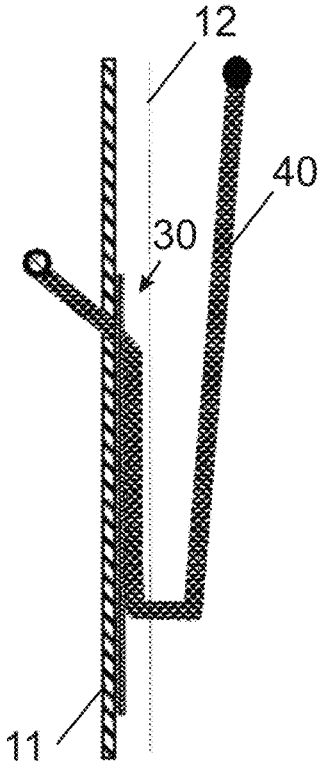
FIG. 6 shows a fifth embodiment of the auxiliary ignition system according to the invention.

FIG. 6 shows a further embodiment of the auxiliary ignition system 30, wherein this is an ignition surface area 30, which is protected against environmental conditions by a jacket 12 in the form of a label. The ignition means 40 is disposed partially outside the jacket 12 and penetrates the jacket 12 in one location such that the ignition means 40 is routed along the surface area-shaped auxiliary ignition system 30 and, from there, is routed into the first receiving part 11. In this embodiment, the auxiliary ignition means 30 has the smallest installation space since the auxiliary ignition system 30, due to the surface area-shaped configuration, can be disposed without difficulty between the receiving part 11 and the jacket 12.

Figure 7:
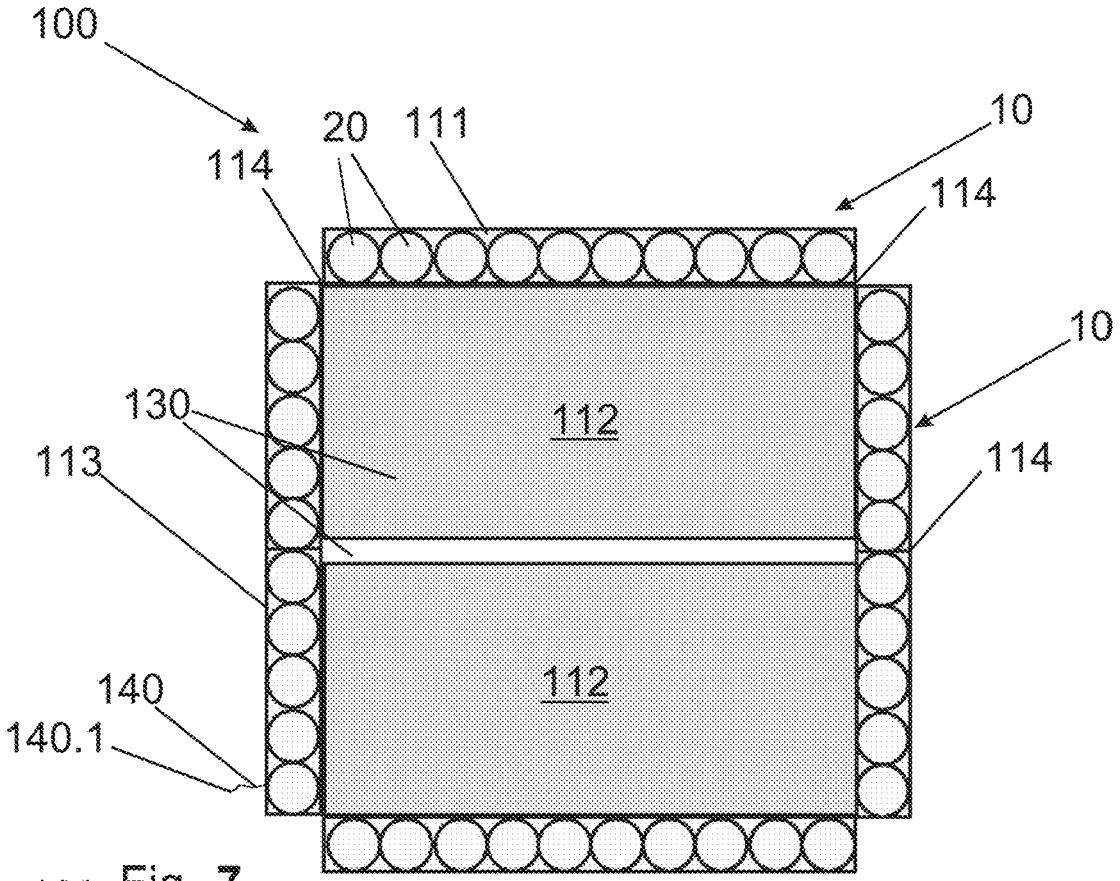
FIG. 7 shows a further embodiment of a firework battery according to the invention.

FIG. 7 shows a firework battery 100 according to the invention, wherein the firework battery 100 comprises two brace elements 112 in the embodiment, which in the illustrated folded-out position hold the receiving parts 111 in the usage position. According to the invention, the brace elements 112 are connected to the one long side of the receiving parts 111 via a hinge part 114 and, in the transport position, can be folded about the hinge part 114, so that the surface area of the brace elements 112 rests against the one surface area of the long receiving part 111, whereby the firework battery 100 assumes the shape shown in FIG. 1 in the transport position. According to the invention, the brace elements 112 can have differing sizes and do not have to become seated against the entire long side of the receiving parts 111. The brace elements 112 shown in FIG. 7 provide extensive bracing action for the receiving parts 111 since they cover the majority of the support base 130 and thus are seated along almost the entire long side of the receiving parts 111.

The brace elements 112 furthermore create a cover for the support base 130, allowing additional information and/or advertisement to be displayed on this defined surface area, and furthermore establishing a surface area which is protected against environmental conditions and on which further pyrotechnic articles 10 can be arranged. It is thus conceivable that the brace elements 112 are made of a material that is at least partially designed to be moisture-proof and/or moisture-inhibiting, whereby the stability of the brace elements 112 is not adversely impacted by moisture.

Figure 8:
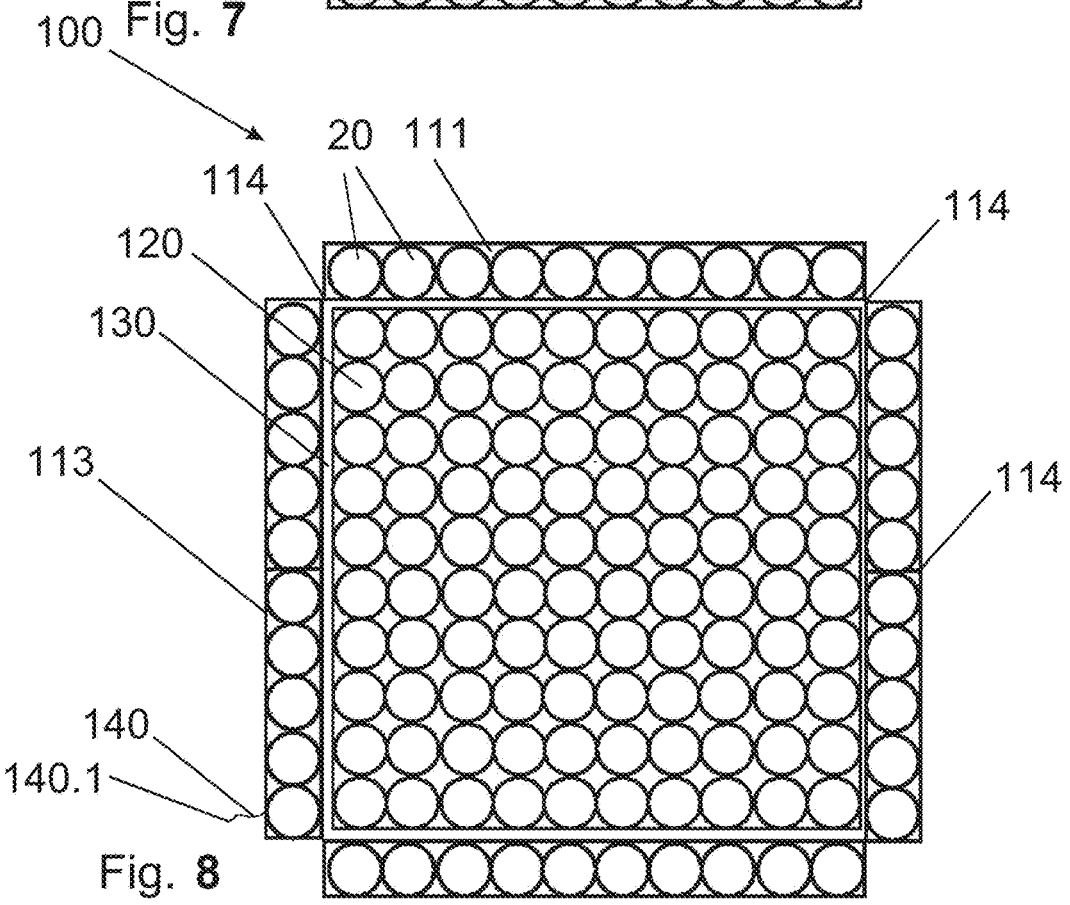
FIG. 8 shows a further embodiment of a firework battery according to the invention.

FIG. 8 shows a further embodiment of the firework battery 100 according to the invention, in which a plurality of pyrotechnic articles 10 are arranged in the defined support base 130. In the illustrated usage position, the receiving parts 111 form a square support base 130, which forms sufficient space for further pyrotechnic charges 20. It is conceivable for further pyrotechnic articles 10 to be arranged on a carrier, which, in the usage position of the firework battery 100, is arranged between the receiving parts 111 on the support base 130, so that the number of pyrotechnic articles 10 is considerably increased, whereby the pyrotechnic effects of the firework battery 100 yield a greater variety in the display.

By arranging the additional pyrotechnic articles 10 on a carrier in the support base 130, an effect comparable to that of the brace elements 112 is achieved. In this way, a displacement of the receiving parts 111 out of the usage position and into the transport position is prevented, whereby increased safety is ensured. Accordingly, numerous advantages result in the embodiment according to FIG. 8, which, in addition to increased safety, also result from a positive influence of the pyrotechnic effects or the number of the pyrotechnic effects.

Figure 9:
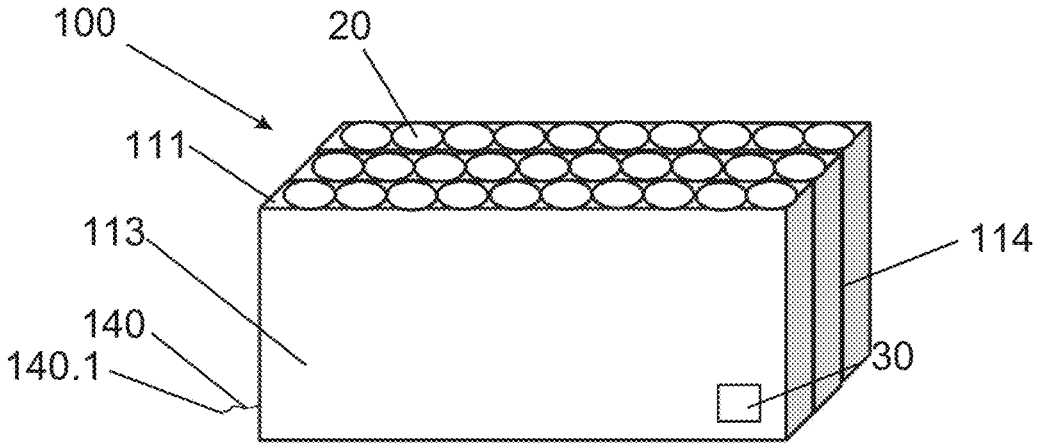
FIG. 9 shows a further embodiment of a firework battery according to the invention.

FIG. 9 illustrates a further embodiment of the firework battery 100 according to the invention formed by three receiving parts 111, in which a plurality of pyrotechnic articles 10 are arranged. In the illustrated transport position, the border 113 has the smallest possible circumference of the shown embodiment. An auxiliary ignition system 30 according to the invention, which allows a pyrotechnic article of a further firework battery to be ignited, is disposed on the outer receiving part 111. This only requires the further firework battery to be positioned, together with an ignition means or an auxiliary ignition system disposed on the further firework battery, in such a way that this can be lit by the igniting flame.

Figure 10:
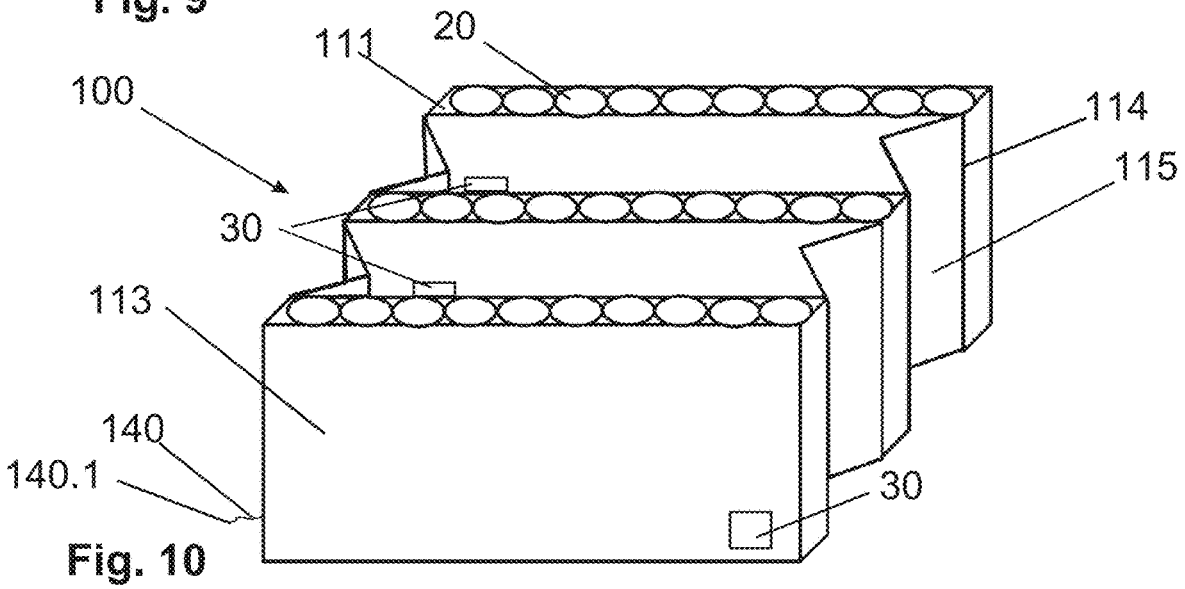
FIG. 10 shows a further embodiment of a firework battery according to the invention.

FIG. 10 shows the further embodiment of the firework battery 100 according to the invention which is also shown in FIG. 9, wherein the extension elements 115 disposed between the receiving parts 111 are apparent in the shown first transport position. In the illustrated first usage position, the three receiving parts 111 are disposed spaced apart from one another in an accordion-like manner, so that the extension elements 115 have acute angles between the receiving parts 111. This considerably increases the defined support base 130 of the firework battery 100 compared to the transport position illustrated in FIG. 9. The border 113 is lengthened by the illustrated extension elements 115, so that the receiving parts 111 are connected by the extension elements 115, resulting in increased stability of the firework battery 100. In FIG. 10, each of the three receiving parts 111 comprises an auxiliary ignition system 30. The auxiliary ignition systems 30 of the central and rear receiving parts 111 are each disposed on the inside. In this way, it is possible for the igniting flame of the rear auxiliary ignition system 30 to light the pyrotechnic articles 10 of the central receiving part 111, wherein advantageously an auxiliary ignition system which is located opposite the auxiliary ignition system 30 of the rear receiving part (not shown in detail here) is disposed on the central receiving part 111. The illustrated auxiliary ignition system 30 of the central receiving part 111 is likewise disposed in such a way that a pyrotechnic article 10 of the front receiving part 111 can be lit by an igniting flame of the auxiliary ignition system 30. Analogously to FIG. 9, an auxiliary ignition system 30 according to the invention, which allows a pyrotechnic article of a further firework battery to be ignited, is disposed on the outer/front receiving part 111.

FIG. 10 furthermore shows a fuse 140 having a fuse end 140.1, which is arranged on a receiving part 111 and used to light at least one pyrotechnic article 10.

Figure 11:
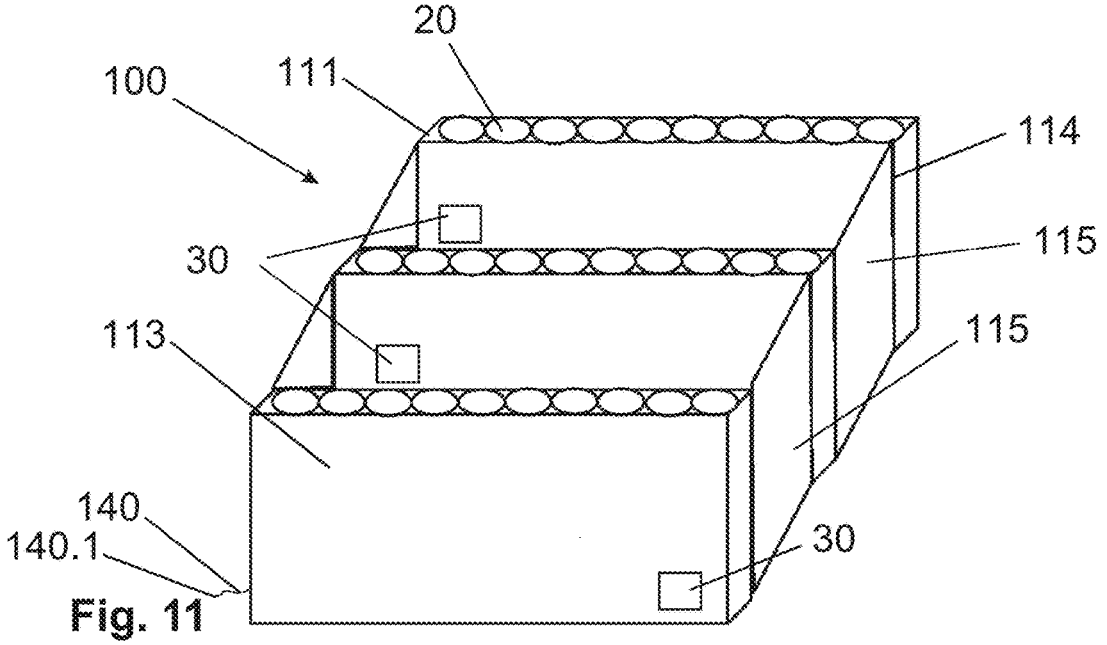
FIG. 11 shows a further embodiment of a firework battery according to the invention.

FIG. 11 shows a further embodiment of the firework battery 100 according to the invention in a second usage position, in which the defined support base 130 is the largest. Compared to the shape shown in FIG. 10, the extension elements 115 have a planar surface area, so that the support base 130 defined between the receiving parts 111 is the largest. In FIG. 11 as well, the receiving parts 111 are shown together with the auxiliary ignition system according to the invention, so that it is also possible to light the pyrotechnic articles 10 of the receiving parts 111 disposed parallel to one another in the second usage position.

Depending on the length of the extension elements 115, the distance between the individual receiving parts 111 can be designed to be larger or smaller. However, the receiving parts 111 are always disposed parallel to and at a distance from one another. It is conceivable that both a rectangular and a trapezoidal arrangement of the firework battery 100 is made possible.

Figure 12:
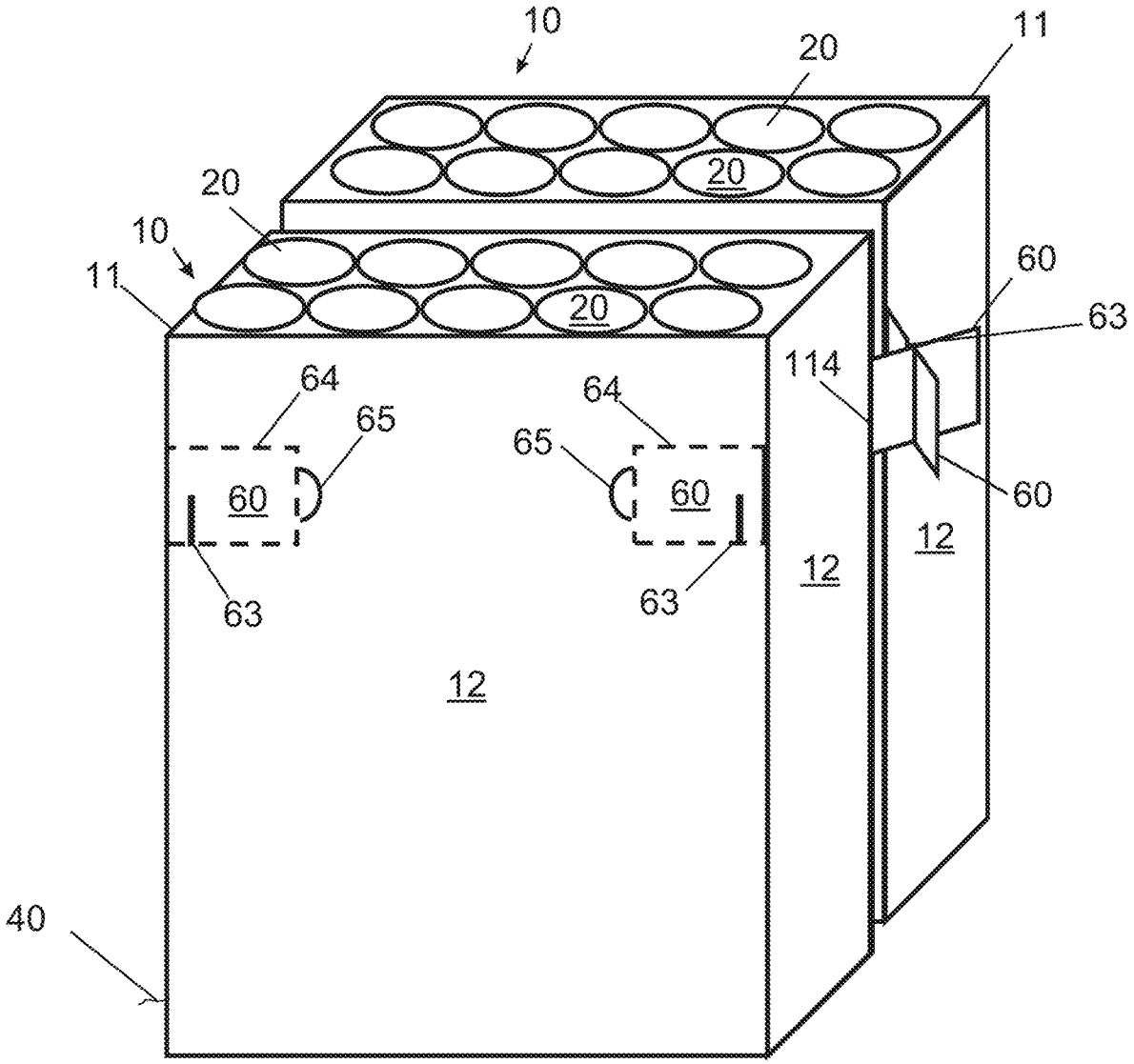
FIG. 12 shows an embodiment of two pyrotechnic articles according to the invention.

FIG. 12 shows two pyrotechnic articles 10, each comprising a receiving part 11 and pyrotechnic effects 20 disposed therein. Positioning aids 60 are disposed on the jacket 12 of the receiving parts 11. The positioning aids 60 each comprise a connecting means 63, wherein two laterally disposed positioning aids 60 are in the open position in which the two connecting means 63 or positioning aids 60 are inserted into one another. The connecting means 63 on the positioning aid 60 is designed as a slot 63 for this purpose, so that these can be interconnected with one another. Two further positioning aids 60 are disposed on the wide side/transverse surface of the front pyrotechnic article 10, which are formed of the jacket 12 and have a perforation 64 and an opening aid 65, so that the positioning aids 60, together with the connecting means 63 disposed thereon, can be easily detached from the jacket. Accordingly, the positioning aids 60 shown in the foreground of FIG. 12 are shown in a closed position on the receiving part 11, wherein an ignition means 40 is disposed on the receiving part 11.

LIST OF REFERENCE NUMERALS 10 pyrotechnic article
11 first receiving part
12 jacket
13 second receiving part
20 pyrotechnic effect
30 auxiliary ignition system
31 igniting flame
40 ignition means
50 isolating element
60 positioning aid
61 support aid
62 safety element
63 connecting means
64 perforation
65 opening aid
100 firework battery
111 receiving part of 100
112 brace element of 100
113 border of 100
114 hinge part of 100
115 extension element of 100
130 support base of 100
140 fuse of 100
140.1 fuse end

What is claimed is:

1. A pyrotechnic article, comprising:

a jacket having at least one first receiving part for containing a first mixture of substances for generating a pyrotechnic effect;

at least one ignition device mounted in the jacket for igniting the first mixture for generating the pyrotechnic effect;

a volumetric body disposed in a second receiving part of the jacket and containing a second mixture of substances;

wherein the volumetric body has an isolating element disposed in the second receiving part to direct an igniting flame horizontally out of the pyrotechnic article, with which an additional pyrotechnic effect generated by at least one additional pyrotechnic article is ignited, wherein the igniting flame is formed by an ignition of the second mixture of substances in the volumetric body.

2. The pyrotechnic article according to claim 1, wherein the isolating element is at least partially disposed between the volumetric body and the first mixture of substances.

3. The pyrotechnic article according to claim 2, wherein the ignition device protrudes at least partially from the first receiving part or from the jacket of the pyrotechnic article.

4. The pyrotechnic article according to claim 1, wherein the first mixture of substances and the volumetric body are pyrotechnically connected to one another by way of the ignition device.

5. The pyrotechnic article according to claim 1, wherein at least one positioning aid or a support aid are disposed on the jacket.

6. The pyrotechnic article according to claim 5, wherein at least the positioning aid or the support aid establishes a mechanical connection between the jacket and an additional pyrotechnic article.

7. The pyrotechnic article according to claim 5, wherein at least the positioning aid or the support aid are movably disposed on the first receiving part.

8. The pyrotechnic article according to claim 5, wherein at least the positioning aid or the support aid is brought at least into a closed position and into an open position, wherein at least the positioning aid or the support aid are disposed flush on the first receiving part in the closed position, and a mechanical connection to the additional pyrotechnic article is established in the open position.

9. The pyrotechnic article according to claim 5, wherein at least the positioning aid or the support aid are disposed in a folding manner on the jacket.

10. The pyrotechnic article according to claim 1, further comprising an isolating element having at least cellulose or gypsum or clay or quartz or metal or ceramic.

11. The pyrotechnic article according to claim 1, wherein a safety element is disposed on the volumetric body, whereby the igniting flame is suppressed from exiting.

12. The pyrotechnic article according to claim 1, further comprising a safety mechanism.

13. The pyrotechnic article according to claim 12, wherein the ignition device is pyrotechnically isolated or connected.

14. The pyrotechnic article according to claim 1, wherein the igniting flame has an angle of radiation $\alpha$ relative to the horizontal in a range between 90° and 0°.

15. The pyrotechnic article according to claim 1, wherein the igniting flame has an exit length in the range of 2 mm and 300 mm.

16. The pyrotechnic article according to a claim 1, wherein the igniting flame has a burn time in the range between 25 seconds and 60 seconds.

17. The pyrotechnic article according to claim 1, wherein the igniting flame is a bengal fire or a shellac fire or a flame surface or a pyrofluid.

* * * * *